US006517368B2

(12) United States Patent
Hara et al.

(10) Patent No.: US 6,517,368 B2
(45) Date of Patent: Feb. 11, 2003

(54) WATERPROOF CONNECTOR AND METHOD OF MANUFACTURING THE SAME

(75) Inventors: Terufumi Hara, Shizuoka-ken (JP); Takao Murakami, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/984,196

(22) Filed: Oct. 29, 2001

(65) Prior Publication Data

US 2002/0052140 A1 May 2, 2002

(30) Foreign Application Priority Data

Oct. 30, 2000 (JP) ..... 2000-331216

(51) Int. Cl.[7] ..... H01R 13/52
(52) U.S. Cl. ..... 439/271; 439/589; 439/904
(58) Field of Search ..... 439/271, 272, 439/273, 275, 274, 887, 589, 279, 904, 634; 277/166, 186

(56) References Cited

U.S. PATENT DOCUMENTS 3,149,897 A * 9/1964 Marineck ..... 439/272
4,621,883 A * 11/1986 Noguchi ..... 439/271
4,810,208 A * 3/1989 Hayes et al. ..... 439/281
5,158,391 A * 10/1992 Fujitani et al. ..... 277/615
5,645,451 A * 7/1997 Ohsumi et al. ..... 277/637
5,779,493 A * 7/1998 Tomita et al. ..... 439/271
6,230,405 B1 * 5/2001 Liu et al. ..... 264/255

FOREIGN PATENT DOCUMENTS

JP 61-179077 8/1986

* cited by examiner

*Primary Examiner*—Gary Paumen
*Assistant Examiner*—James R. Harvey
(74) *Attorney, Agent, or Firm*—Finnegan, Henderson, Farabow, Garrett, & Dunner, L.L.P.

(57) ABSTRACT

A waterproof connector comprises an inner housing made of synthesis resin, which accommodates a connection terminal; an outer housing made of synthesis resin, which surrounds the inner housing inserted in an insertion port with a predetermined space portion therebetween, the outer housing having an insertion port in its block wall, the insertion port being for inserting the inner housing, and an enter port provided in its tip end; and a sealing member inserted in the space portion, wherein a holding projection extending from the sealing member to the block wall is provided, a through hold inserting the holding projection therein is provided in the block wall, and the holding projection is inserted in the through hole. In such a constitution, thermoplastic resin covers at least an exposed portion of the holding projection, which is exposed from the through hole, from the outside of the block wall.

2 Claims, 5 Drawing Sheets

WATERPROOF CONNECTOR AND METHOD OF MANUFACTURING THE SAME

BACKGROUND OF THE INVENTION

The present invention relates to a waterproof connector which is designed to be waterproof in the inside thereof by a sealing member such as a packing inserted therein, and a method of manufacturing the same.

As a conventional waterproof connector, there has been disclosed, for example, in Japanese Patent Laid-Open No. 61(1986)-179077, which is shown in FIGS. 1 and 2. FIG. 1 is an exploded perspective view showing a waterproof connector 1 and a connector 2, which constitutes a mating pair. In this mating pair, the waterproof connector 1 is one mate and the connector 2 is the other mate. As shown in FIG. 2, the waterproof connector 1 comprises an inner housing 5 positioned in an outer housing 3 with a predetermined space S therebetween. The inner housing 5 accommodates a connection terminal 4*a* of one wire 4. A packing 6 made of rubber is inserted between the outer housing 3 and the inner housing 5.

On the other hand, as shown in FIG. 1, the connector 2 of the other mate comprises a housing 7 which is allowed to be entered in the predetermined space S, and the housing 7 accommodates a connection terminal 8*a* of the other wire 8 in its rear end portion. The connection terminal 8*a* and the connection terminals 4*a* are designed so that they are engaged with the housing 7 and the inner housing 5 by spacers 9 and 9*a,* respectively.

The housing 7 of the connector 2 of the other mate is allowed to be entered in the predetermined space S of the waterproof connector 1, whereby the connection terminal 4*a* of one mate and the connection terminal 8*a* of the other mate contact with each other. Then, the packing 6 is pressed toward a bottom wall 3*a* of the outer housing 3 by a step portion (not shown) formed inside the tip end of the housing 7. Thus, the packing 6 swells in its thickness direction by being compressed between the bottom wall 3*a* and the step portion, and a space between an outer circumference of the inner housing 5 and an inner circumference of the housing 7 is sealed liquid-tightly.

However, in the conventional waterproof connector 1, a waterproof function by use of the packing 6 is not exerted until the packing 6 swells in its thickness direction by entering the connector 2 of the other mate in the waterproof connector 1. In a state where the connector 2 of the other mate is not inserted in the waterproof connector 1, the packing 6 should be inserted in the outer circumference of the inner housing 5 softly without allowing the packing 6 to be compressively contacted thereto, from viewpoints of durability of the packing 6.

Therefore, in the case where an enter port 1*a* of the waterproof connector 1 is connected to the connector 2 of the other mate so as to be directed downward, the packing 6 may easily fall from the enter port 1*a*. When the packing 6 falls, a connection operation needs to be performed after inserting the packing 6 again. Also in such a case, a device is required, in which a connection operation is performed while closing the enter port 1*a* with fingers so that the packing 6 does not fall again. Therefore, much time is required for assembling the waterproof connector 1, thus deteriorating operationality.

SUMMARY OF THE INVENTION

Accordingly, the present invention was made to solve the conventional problems, and an object of the present invention is to provide a waterproof connector capable of surely preventing a sealing member from coming away from an outer housing without increasing cost significantly, by fixing the sealing member to the outer housing with simple means, the sealing member being inserted for waterproof. The object of the present invention is also to provide a method of manufacturing the waterproof connector.

The waterproof connector of the present invention as defined in claim 1 comprises an inner housing accommodating a connection terminal; an outer housing surrounding the inner housing inserted in an insertion port with a predetermined space portion therebetween and having the insertion port provided in a block wall and an enter port provided in its tip end; and a sealing member inserted in the space portion, wherein a holding projection extending from the sealing member to the block wall is provided, a through hole inserting the holding projection therein is provided in the block wall, and the holding projection is inserted in the through hole. In such a constitution, thermoplastic resin covers at least an exposed portion of the holding projection, which is exposed from the through hole, from the outside of the block wall.

In this case, the sealing member, which is inserted in the space portion between the outer housing and the inner housing, allows the holding projection, which is provided so as to protrude from the sealing member, to be inserted in the through hole formed in the block wall of the outer housing. At this time, since the exposed portion of the holding projection exposed from the through hole is at least covered with the thermoplastic resin from the outside of the block wall, the exposed portion is fixed to the block wall by the thermoplastic resin. Thus, with a simple structure in which the holding projection is formed in the sealing member, the through hole is formed in the block wall, and the thermoplastic resin is filled by inserting the holding projection in the through hole, the sealing member can be surely fixed to the outer housing.

In the waterproof connector as defined as claim 1, the waterproof connector of the present invention as defined in claim 2 is characterized in that the whole of the protrusion portion is covered with the thermoplastic resin extending from the outside of the block wall of the outer housing to the outside of the protrusion portion of the inner housing.

In this case, by covering the whole protrusion portion of the inner housing from the outside of the block wall of the outer housing to the outside of the protrusion portion of the inner housing with the thermoplastic resin, the portion of the inner housing inserted in the insertion port and the portion accommodating the connection terminal can be fixed by the thermoplastic resin and liquid-tightly sealed.

A manufacturing method of the waterproof connector of the present invention as defined in claim 3 comprises the steps of: inserting an inner housing accommodating a connection terminal from an insertion port provided in a block wall of an outer housing; inserting and squeezing a sealing member in a predetermined space portion provided between an outer housing and the inner housing from an enter port provided in a tip end of the outer housing; inserting a holding projection provided so as to protrude from the sealing member in a through hole provided in the block wall; and covering at least an exposed portion of the holding projection exposed from the through hole with thermoplastic resin from the outside of the block wall.

In this case, since the sealing member can be inserted in the predetermined space portion as a guide space, which is provided between the outer housing and the inner housing, the sealing member can be guided easily and surely to a position facing the block wall by being simply squeezed toward the inside of the space portion in the state where the sealing member is inserted in the space portion. Therefore, the holding projection is easily inserted in the through hole of the block wall by squeezing the sealing member. After the holding projection is inserted in the through hole in such a manner, at least the exposed portion of the holding projection is covered with the thermoplastic resin from the outside of the block wall, whereby the sealing member is easily fixed to the outer housing.

DETAILED DESCRIPTION OF THE PREFERRED EMBODIMENT

An embodiment of a waterproof connector according to the present invention will be described in detail with reference to the accompanying drawings below.

Figure 1:
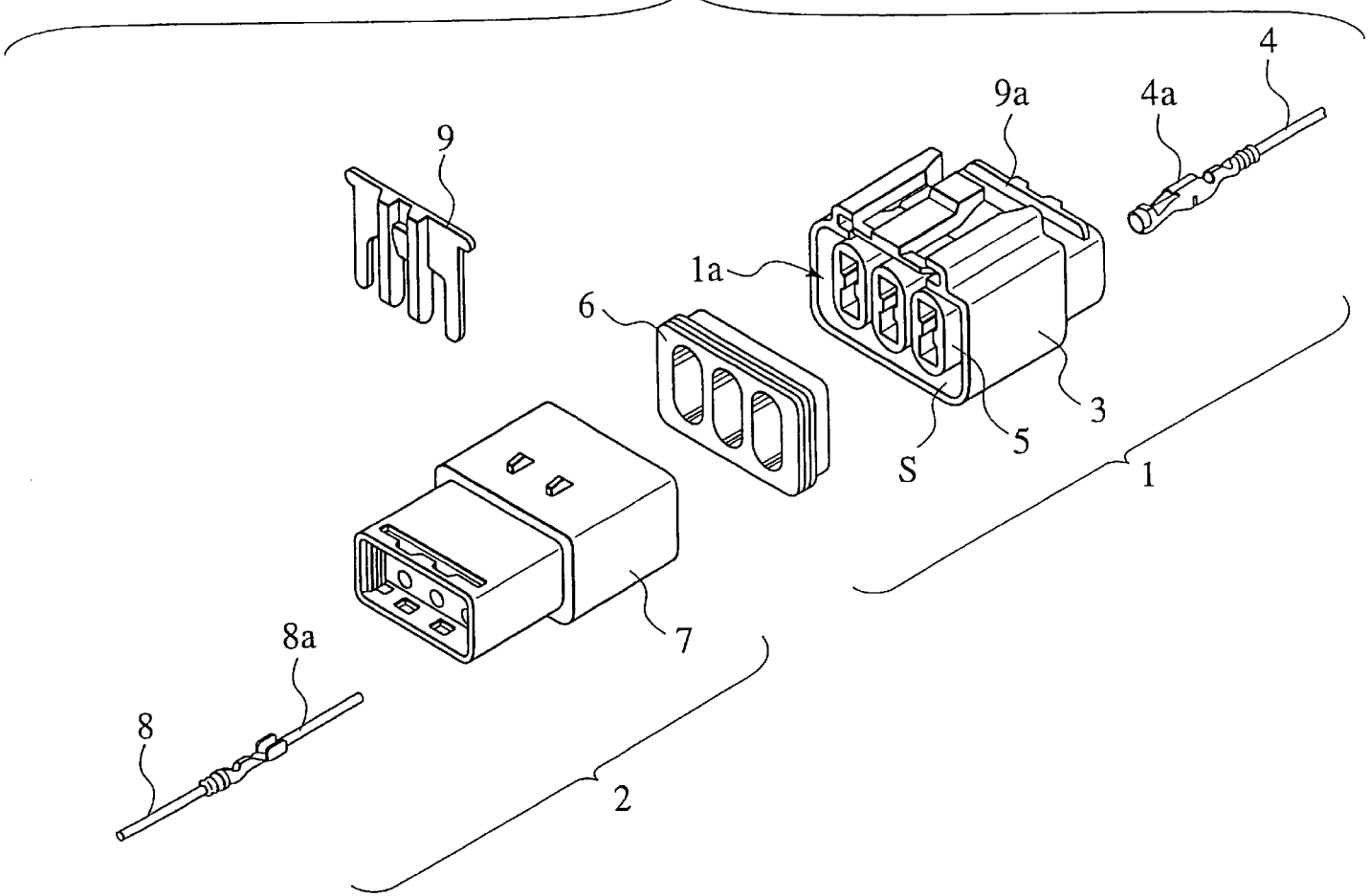
FIG.1 BACKGROUND ART
FIG. 1 is an exploded perspective view of a conventional waterproof connector.
Figure 2:
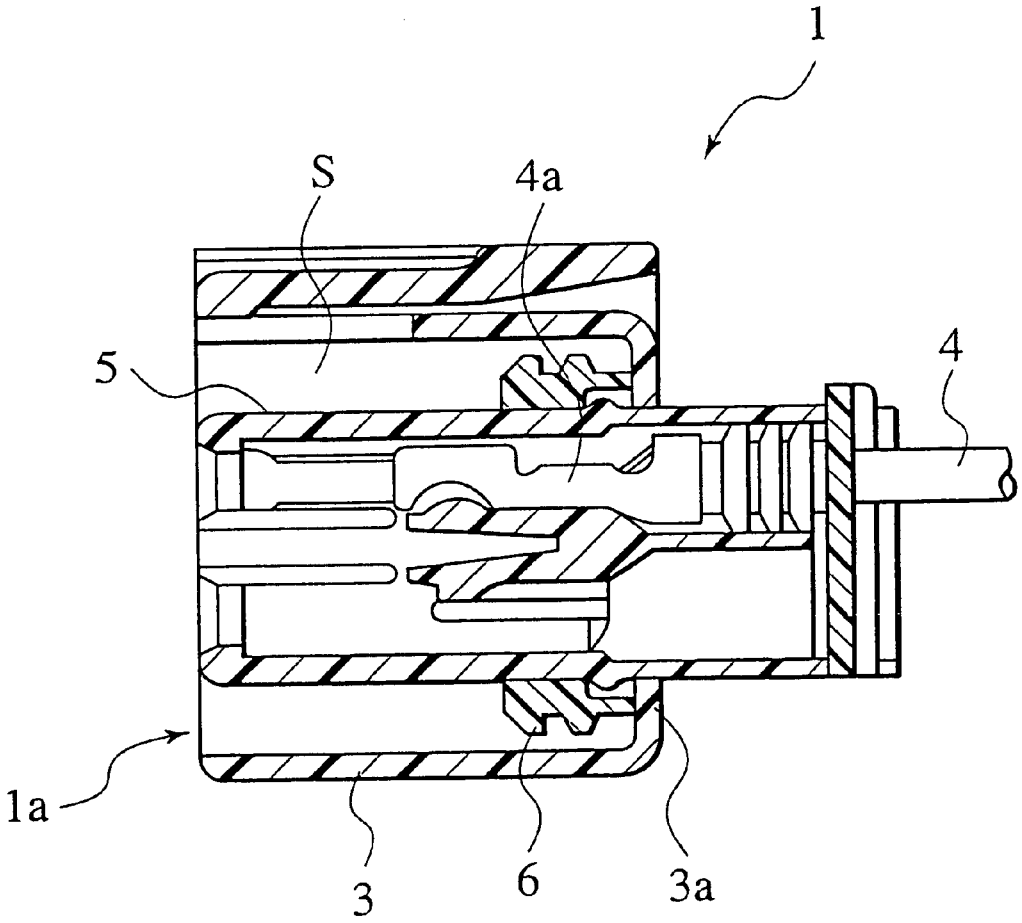
FIG.2 BACKGROUND ART
FIG. 2 is a section view showing a state where assembly of the conventional waterproof connector has completed.
Figure 3:
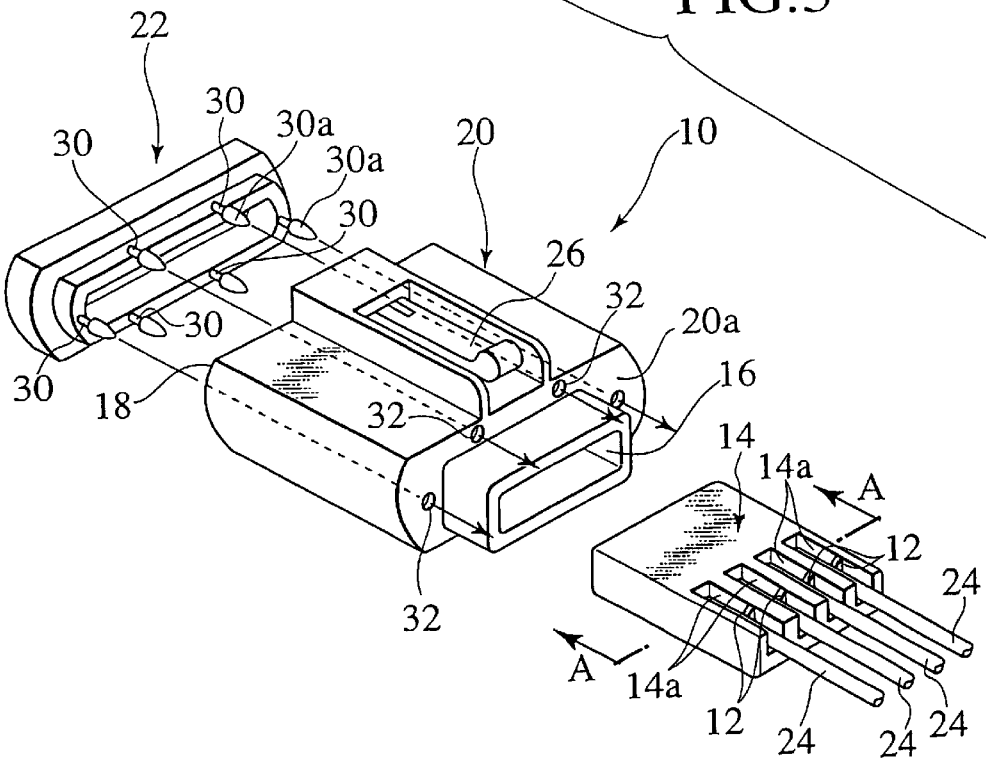
FIG. 3 is an exploded perspective view showing an embodiment of a waterproof connector according to the present invention.
Figure 4:
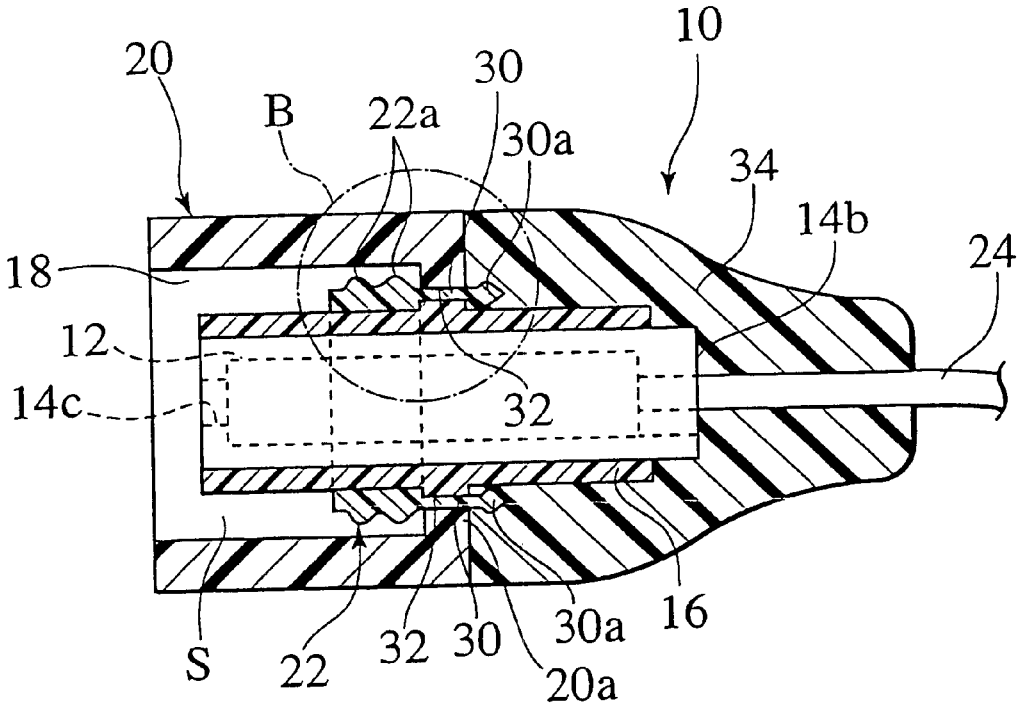
FIG. 4 is a section view showing a state where assembly of the waterproof connector of the embodiment according to the present invention has completed.
Figure 5:
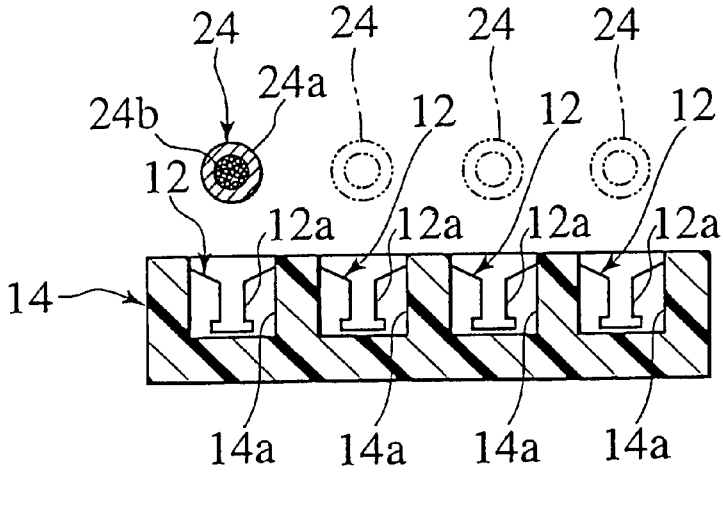
FIG. 5 is an enlarged section view taken along the line A—A in FIG. 3, which shows the embodiment of the waterproof connector according to the present invention.
Figure 6:
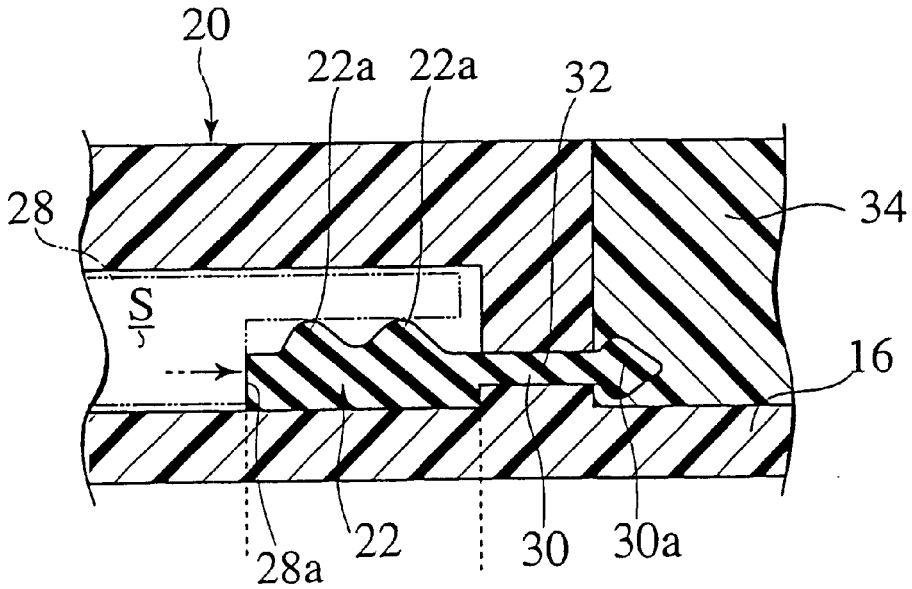
FIG. 6 is an enlarged section view of a portion B in FIG. 4, which shows the embodiment of the waterproof connector according to the present invention.

FIGS. 3 to 6 show an embodiment of a waterproof connector according to the present invention. FIG. 3 is an exploded perspective view of the waterproof connector. FIG. 4 is a section view showing a state where assembly of the waterproof connector has completed. FIG. 5 is an enlarged section view taken along the line A—A in FIG. 3. FIG. 6 is an enlarged section view of a portion B in FIG. 4.

As shown in FIG. 3, a waterproof connector 10 comprises an inner housing 14 made of synthetic resin, which accommodates a plurality of connection terminals 12; an outer housing 20 made of synthetic resin; and a packing 22 as a sealing member to be inserted in a space portion S (see FIG. 4) provided in the outer housing 20. The outer housing 20 has a block wall 20*a* at its one end, and an insertion port 16 provided in the block wall 20*a,* which serves as a housing insertion pipe portion for inserting the inner housing 14 thereinto. The outer housing 20 surrounds the inner housing 14 with the predetermined space portion S therebetween when the inner housing 14 is inserted form the insertion port 16 thereinto. The outer housing 20 has an enter port 8 at the other end thereof.

The inner housing 14 comprises the plurality of connection terminals 12, each of which is coupled to corresponding one of a plurality of wires 24, for example, four wires in this embodiment. As these connection terminals 12, for example, a crimp-style terminal and a press-connection terminal can be used, which are capable of make a sure connection of these terminals with the wires 24. In this embodiment, the latter press-connection terminal is used as shown in FIG. 5, and the wire 24 is squeezed into a press-connection edge 12*a* of the press-connection terminal 12 without cutting off an insulative cover 24*a* of the wire 24. Thus, it is possible to allow a conductor 24*b* of the wire 24 to electrically contact the press-connection edge 12*a* thereof, making a press-connection of the wire 24 with the press-connection terminal 12.

Furthermore, the inner housing 14 is monolithically molded from synthesis resin into an approximately flat rectangular parallelpiped shape. A plurality of terminal accommodating chambers 14*a* for accommodating the press-connection terminals 12 individually are provided in parallel in portions of the inner housing 14 which extend from the center thereof to the right end thereof as shown in FIGS. 3 and 4. The inner housing 14 and the outer housing constitute a mating pair, and the inner housing 14 as one mate of the mating pair has insertion holes 14*c* through which terminals (not shown) of the outer housing 20 as the other mate are inserted so as to correspond to the respective press-connection terminals 12.

As shown in FIG. 3, the outer housing 20 is monolithically molded into an approximately rectangular parallelepiped cylinder having a bottom from synthesis resin, in which the block wall 20*a* is formed in its rear portion. A cylindrical insertion port 16 for inserting the inner housing 14 is formed in the block wall 20*a.* As shown in FIG. 4, this insertion port 16 is formed to a cylindrical shape so that the insertion port 16 continuously protrudes from the inside of the block wall 20*a* to the outside thereof. A length of the insertion port 16 is made to be approximately equal to that of an insertion direction of the inner housing 14, so that the insertion port 16 can hold the inner housing 14 inserted in the cylindrical insertion port 16. Moreover, the cylindrical insertion port 16 terminates at a position inside the enter port 18 positioned at the front end of the outer housing 20 so that a front end portion of the insertion port 16 does not protrude from the enter port 18.

A predetermined space portion S for inserting a connector 28 of the outer mate is provided between an external circumference of the cylindrical insertion port 16 which protrudes toward the inside of the outer housing 20 and an internal surface of the outer housing 20 (see FIG. 6). Thus, the space portion S is provided between the outer housing 20 and the inner housing 14. Herein, when the inner housing 14 is exposed directly at a portion including the inner housing 14 and the insertion portion 16 in the outer housing 20 because the insertion port 16 is short, the space portion S is provided on the inner housing 14 side between the inner housing 14 and the outer housing 20. At a central portion of an upper surface of the outer housing 20, provided is a detachable lock means 26 which elastically engages with the connector 28 of the other mate.

The packing 22 is formed to a ring shape from an elastic material such as rubber, which substantially conforms to the external shape of the insertion port 16 positioned in the outer housing 20, and a convex streak 22*a* is provided in an external circumference of the packing 22, which continues in a circumference direction of the packing 22. When the packing 22 is inserted in the space portion S, an inner circumference of the packing 22 is softly inserted in the external circumference of the insertion port 16, and a gap is provided between the external circumference of the packing 22 and the inner circumference of the outer housing 20. The connector 28 of the other mate shown in FIG. 6 is entered in the gap to be fitted. At this time, when the packing 22 is compressed in the insertion direction at a step portion 28*a* of the connector 28 of the other mate that is entered, the packing 22 swells in its thickness direction and seals the enhanced circumference of the cylindrical insertion port 16 and the inner circumference of the connector 28 of the other mate.

Herein, as shown in FIG. 3, a holding projection 30 is provided so as to extend from the packing 22 toward the block wall 20*a* of the outer housing 20. As shown in FIG. 4, a through hole 32 for inserting the holding projection 30 is provided in the block wall 20*a,* and the holding projection 30 is inserted in the through hole 32 so that thermoplastic resin 34, for example, thermoplastic polyamide resin such as hot melt adhesive, covers from the outside of the block wall 20*a* of the outer housing 20 at least a swelling portion 30*a* as an exposed portion of the holding projection 30, which exposes from the through hole 32.

More than one holding projection 30 are provided at proper intervals in the circumference direction of the packing 22 integrally with the end plane of the packing 22, and the swelling portion 30*a* having an arrowhead shape is formed in a tip end of each holding projection 30. On the other hand, the through hole 32 is formed at a position so as to correspond to each of the holding projection 30, and each holding projections 30 is inserted in corresponding one of the through holes 32. At this time, a projection length of the holding projection 30 is made so as to be longer than the thickness of the block wall 20*a,* and is equal to that of the swelling portion 30*a*. Accordingly, when the holding projection 30 is inserted in the through hole 32, the holding projection 30 penetrates through the through hole 32 and the swelling portion 30*a* protrudes to the outside of the block wall 20*a*.

As shown in FIG. 4, in a state where the holding projection of the packing 22 is inserted in the through hole 32 of the outer housing 20 and the swelling portion 30*a* of the packing 22 protrudes to the outside of the block wall 20*a* of the outer housing 20, the swelling portion 30*a* is covered with the thermoplastic resin 34 such as the thermoplastic polyamide resin. Thus, a protrusion portion 14*b* of the inner housing 14 is wholly covered with the thermoplastic resin 34 extending from the outside of the block wall 20*a* of the outer housing 20 to the outside of the protrusion portion 14*b* of the inner housing 14.

As well known in general, the thermoplastic resin 34 is a resin material which becomes like liquid and shows fluidity after being heated and returns to its original solid state by being cooled, and a material as the thermoplastic resin 34 is selected depending on a material of an object to which the thermoplastic resin 34 is to be fixed. As the thermoplastic resin 34 used in this embodiment, thermoplastic polyamide resin is used, which shows excellent adhesive properties for both of the synthesis resin forming the inner housing 14 and the outer housing 20 and the rubber material forming the packing 22. The thermoplastic resin 34 is not limited to the thermoplastic polyamide resin, but a material showing effective fixing properties for the synthesis resin and the rubber material can be used. Moreover, when the materials of the inner housing 14, the outer housing 20 and the packing 22 are changed, materials showing good fixing properties for the respective materials are selected.

To manufacture the waterproof connector 10 with such a constitution, the inner housing 14 accommodating the press-connection terminals 12 is inserted in the cylindrical insertion port 16 provided in the block wall 20*a* of the outer housing 20. Next, by use of the space portion S as a guide space, the packing 22 is inserted from the enter port 18, which is provided in the tip end of the outer housing 20, in the predetermined space portion S provided between the outer housing 20 and the inner housing 14, and the packing is squeezed thereinto. The holding projection 30 provided so as to protrude from the packing 22 is inserted in the through hole 32 provided in the block wall 20*a* of the outer housing 20, and, in the state, the swelling portion 30*a* of the holding projection 30, which exposes from the through hole 32, is covered with the melted thermoplastic resin 34 from the outside of the block wall 20*a* of the outer housing 20 to be cured, thus completing the waterproof connector 10.

With such a constitution, in the waterproof connector 10 of this embodiment, as shown in FIG. 6, the packing 22 inserted in the space portion S between the outer housing 20 and the inner housing 14 liquid-tightly seals a space between the external circumference of the cylindrical insertion port 16 and the internal circumference of the connector 28 of the other mate, whereby the inside of the inner housing 14, that is, the electrical connection portion of the press-connection terminal 12 and the terminal of the other mate (not shown) connecting thereto, can be waterproofed.

At this time, the packing 22 inserted in the space portion S allows the holding projection 30, which is provided so as to protrude from the packing 22, to be inserted in the through hole 32 formed in the block wall 20*a* of the outer housing 20. Since the swelling portion 30*a* protruded from the through hole 32 when the holding projection 30 in inserted in the through hole 32 is covered with the thermoplastic resin 34 from the outside of the block wall 20*a,* the swelling portion 30*a* of the packing 22 is adhered to the block wall 20*a* of the outer housing 20 by the thermoplastic resin 34, and thus the whole of the packing 22 can be fixed to the outer housing 20. Accordingly, with a simple structure in which the holding projection 30 is formed in the packing 22, the through hole 32 is formed in the block wall 20*a,* and the thermoplastic resin 34 is filled, it is possible to surely prevent the packing 22 from coming away from the outer housing 20 without increasing cost greatly. Therefore, since there is not uneasiness that the packing 22 may fall in assembling the waterproof connector 10, the waterproof connector 10 can be assembled quickly and surely, leading to an increase in working efficiency.

When the swelling portion 30*a* of the holding projection 30 of the packing 22 is fixed by the thermoplastic resin 34, the whole of the protrusion portion 14*b* is covered with the thermoplastic resin 34 extending from the outside of the block wall 20*a* of the outer housing 20 to the outside of the protrusion portion 14*b* of the inner housing 14. Thus, the portion of the inner housing 14 inserted in the insertion port 16 and the portion of the press-connection terminal 12 accommodated in the terminal accommodating chamber 14*a* can be fixed by the thermoplastic resin 34 and liquid-tightly sealed. Accordingly, the inserted portion of the inner housing 14 and the press-connection portion where the press-connection terminal 12 and the wire 24 are thrust to be connected to each other are reinforced, thus increasing their fixing properties and preventing failure in an electrical connection. At the same time, liquid-tight properties of the inserted portion and the press-connection portion can be increased, and a waterproof function of the rear end of the waterproof connector 10 can be further improved.

By the way, when the holding projection 30 of the packing 22 is inserted in the through hole 32 of the block wall 20*a* in manufacturing the waterproof connector 10 of this embodiment, the packing 22 is inserted by use of the predetermined space portion S as the guide space, which is provided between the outer housing 20 and the inner housing 14, and the packing 22 is simply squeezed toward the inside of the space portion S in a state where the packing 22 is inserted therein. Thus, the packing 22 can be guided into a position facing the block wall 20*a* easily and surely. Therefore, the holding projection 30 can be easily inserted in the through hole 32 by squeezing the packing 22. After the holding projection 30 is inserted in the through hole 32 in the above-described manner, the packing 22 can be easily fixed to the outer housing 20 by covering the swelling portion 30*a* of the holding projection 30, exposed from the through hole 32, with the thermoplastic resin 34. For this reason, the manufacture of the waterproof connector 10 is made to be easier, and it is possible to achieve a reduction in the manufacturing cost significantly.

Incidentally, in this embodiment, since the swelling portion 30*a* formed in the tip end of the holding projection 30 of the packing 22 protrudes to the outside of the through hole 32 of the outer housing 20, the swelling portion 30*a* is covered with the thermoplastic resin 34. However, the holding projection 30 needs not always to protrude from the through hole 32, and as long as the tip end of the holding projection 30 is exposed to the outside of the through hole 32, the thermoplastic resin 34 adheres to the exposed portion of the holding projection 30, thus fixing the packing 22 to the outer housing 20.

Although the case where the packing 22 swells in its thickness direction by compressing the packing 22 in its insertion direction and the packing 22 shows a sealing function was described, the sealing function is not limited to this. Any sealing function will do as long as a liquid-tight property between the inner housing 14 and the connector 28 of the other mate can be secured. For example, the sealing function may be exerted only by compression in which the packing 22 is thrust against the block wall 20*a* of the outer housing 20 by use of the tip end of the connector 28 of the other mate.

As described above, according to the waterproof connector of the present invention as defined in claim 1, when the sealing member is inserted in the space portion between the outer housing and the inner housing, the holding projection provided so as to protrude from the sealing member is inserted in the through hole formed in the block wall of the outer housing. And, since at least the exposed portion of the holding projection exposed from the through hole is covered with the thermoplastic resin from the outside of the block wall, the exposed portion can be fixed to the block wall by the thermoplastic resin. Therefore, with the simple structure in which the holding projection is formed in the sealing member, the through hole is formed in the block wall, and the thermoplastic resin is filled after inserting the holding projection in the through hole, it is possible to surely fix the sealing member to the outer housing. Thus, it is possible to prevent the sealing member from coming away from the outer housing without increasing the cost of the waterproof connector. Therefore, it is possible to enhance the working efficiency in assembling the waterproof connector.

According to the waterproof connector of the present invention as defined in claim 2, since the whole of the protrusion portion is covered with the thermoplastic resin covering the exposed portion of the holding projection, which extends from the outside of the block wall of the outer housing to the outside of the protrusion portion of the inner housing, the portion of the inner housing inserted in the insertion port and the portion accommodating the press-connection terminal inserted in the terminal accommodating chamber can be fixed by the thermoplastic resin and liquid-tightly sealed. Accordingly, the inserted portion of the inner housing and the press-connection portion where the press-connection terminal and the wire are thrust to be connected to each other are reinforced, thus increasing their fixing properties and preventing failure in an electrical connection. At the same time, liquid-tight properties of the inserted portion and the press-connection portion can be increased, and a waterproof function of the waterproof connector can be further increased.

According to the manufacturing method of the waterproof connector of the present invention as defined in claim 3, when the holding projection of the sealing member is inserted in the through hole of the outer housing, the sealing member is inserted by use of the predetermined space portion provided between the outer housing and the inner housing as the guide space. Accordingly, by squeezing the sealing member toward the inside of the space portion, the sealing member is easily and securely guided to a position facing the block wall of the outer housing, and the holding projection of the sealing member can be easily inserted in the through hole. In such a manner as described above, after the holding projection in inserted in the through hole, at least the exposed portion of the holding projection is covered with the thermoplastic resin from the outside of the block wall, and thus the sealing member can be fixed to the outer housing. Therefore, the manufacture of the waterproof connector can be made simple, and lowering of the cost for manufacturing the waterproof connector can be further achieved.

The entire content of Japanese Patent Application No. P2000-331216 with a filing date of Oct. 30, 2000 is herein incorporated by reference.

Although the invention has been described above by reference to the preferred embodiment, the invention is not limited to the embodiment described above will occur to those skilled in the art, in light of the teachings. The scope of the invention is defined with reference to the following claims.

What is claimed is:

1. A waterproof connector comprising:

a connection terminal;

an inner housing having a protrusion portion accommodating the connection terminal;

an outer housing comprising a tip end and rear end opposite the tip end, a block wall located at the rear end of the outer housing, the block wall having an insertion port and at least one through hole, the inner housing being received in the insertion port such that the protrusion portion of the inner housing extends from a side of the block wall remote from the tip end and such that another end of the inner housing extends toward the tip end of the outer housing thereby defining a space portion between the inner housing and the outer housing, and a packing enter port provided at the tip end the outer housing;

a sealing member inserted in the space portion, the sealing member having at least one holding projection extending into the at least one through hole provided in the block wall at the rear end of the outer housing; and a thermoplastic resin portion covering and adhering to at least an exposed portion of the at least one holding projection that is exposed from the at least one through hole when the at least one holding projection is inserted into the at least one through hole.

2. The waterproof connector of claim 1, wherein the thermoplastic resin portion covers the entire protrusion portion of the inner housing from the side of the block wall remote from the tip end to an end of the protrusion portion of the inner housing.

* * * * *